United States Patent [19]

Jensen et al.

[11] Patent Number: 4,775,292

[45] Date of Patent: Oct. 4, 1988

[54] PUMP COMPRISING A GAS SEPARATOR

[75] Inventors: Niels D. Jensen, Bjerringbro; Jorgen D. Nielsen, Ulstrup, both of Denmark

[73] Assignee: Grundfos International A/S, Bjerringbro, Denmark

[21] Appl. No.: 69,249

[22] Filed: Jul. 2, 1987

[30] Foreign Application Priority Data

Jul. 8, 1986 [DK] Denmark ..... 3252/86

[51] Int. Cl.[4] ..... F01D 25/30

[52] U.S. Cl. ..... 415/168; 415/205; 55/204

[58] Field of Search ..... 415/121 A, 168, 182, 415/183, 184, 205; 55/201, 204, 205, 459 R, 460; 210/512.1, 512.2; 209/211

[56] References Cited

U.S. PATENT DOCUMENTS 2,732,032 1/1956 Sandison ..... 415/168 X
3,715,863 2/1973 Zanoni ..... 55/204
4,358,299 11/1982 Jensen et al. ..... 55/204
4,447,189 5/1984 Jensen et al. ..... 415/168
4,504,187 3/1985 MacInnes et al. ..... 415/205

*Primary Examiner*—Robert E. Garrett
*Assistant Examiner*—Joseph M. Pitko
*Attorney, Agent, or Firm*—Michael N. Meller

[57] ABSTRACT

On the suction side of its pump housing a pump is provided with a gas separator optionally built integrally with the pump housing. The gas separator comprises a cyclone chamber with an inlet channel for a gas or air-containing pump medium, and a liquid outlet channel connected to the inlet of the pump. A bleed housing is provided at the upper end of the cyclone chamber, said bleed housing comprising an air duct. The air duct is substantially Z-shaped and of a cross section deviating from circular shape. The air duct comprises furthermore a relatively wide groove over at least a portion of its length and at its upper wall. The groove extends from adjacent the inlet of the air duct and forwards into said duct. In this manner a separation of gas or air from the gas or air-containing pump medium is obtained which is more reliable than the previously known separation.

7 Claims, 4 Drawing Sheets

PUMP COMPRISING A GAS SEPARATOR

FIELD OF THE INVENTION

The invention relates to a pump preferably a centrifugal pump comprising a gas separator mounted on the suction side of the pump housing and optionally built integrally with said pump housing, where the gas separator comprises a cyclone chamber with an inlet channel for a gas or aircontaining pump medium, a liquid outlet channel connected to the inlet of the pump, and a bleed housing mounted at the upper end of the cyclone chamber and comprising an air duct.

BACKGROUND ART

In a known centrifugal pump the suction side is provided with a gas separator which may be a separate or integral part of the pump housing. The gas separator comprises a cyclone chamber with an inlet channel for the pump medium to be purified of gas or air, and a liquid outlet channel connected to the inlet of the pump, as well as a bleed housing situated at the upper end of the cyclone chamber and comprising an air duct removing the gas or air separated in the cyclone chamber. Such a pump does not, however, operate completely satisfactory because liquid sometimes blocks the air duct of the bleed housing, especially when more water enters the cyclone chamber than can be contained therein. Such a liquid blockage is completely detrimental to the operation of the gas separator, and a consequence of the presence thereof is that the water entering the inlet of the centrifugal pump contains undesired bubbles of gas or air, said bubbles interfering with the rotation of the impeller of the pump.

SUMMARY OF THE INVENTION

The object of the present invention is to provide a pump of the above type which can separate gas or air from a gas or air-containing pump medium in a more reliable manner than previously, the risk of water bubbles in the air duct of the bleed housing being almost eliminated.

The pump according to the invention is characterized in that the air duct is substantially Z-shaped and of a cross section deviating from a circular shape, and that at least over a portion of its length the air duct comprises a relatively wide groove in its upper wall, said groove extending from adjacent the inlet of the air duct to adjacent the outlet 19 of said duct. In this manner the risk of formation of water bubbles in the air duct is highly reduced because even small amounts of gas or air liberated in the cyclone chamber penetrate very fast to the upper portions of the bleed housing, i.e. the amounts follow the groove. In case of a water blockage the gas or air can easily press itself past the blockage through the groove and thereby disintegrate said blockage, i.e. make it flow out. Subsequently the total cross section of the air duct is again passable for the air.

According to the invention the cross section of the Zshaped air duct may be substantially clover leaf-shaped at the inlet of the duct, i.e. at the connection between the duct and the cyclone chamber, and a portion of the duct opposing one of the partial leaves of the clover leaf may form an inlet surface for the gas or the air, said inlet surface continuing into said groove. As a result small amounts of gas and air penetrate particularly easily from the cyclone chamber and into the groove so as to disintegrate possible water blockages.

Furthermore according to the invention the cross section of the Z-shaped air duct may be substantially heartshaped adjacent the inlet of the duct. The heart-shaped cross section is situated at the connection of the inlet surface in question.

Moreover, according to the invention the Z-shaped air duct may in the middle be of a cross section composed of a cross-sectional portion shaped as a substantially compressed oval and a cross-sectional portion corresponding to said groove. The oval portion of the cross section hampers formation of water blockages, and should a water blockage occur, it is relatively fast disintegrated.

According to the invention the groove may be of a length in the range of 0.4–0.7 times L, where L is the length of the Z-shaped air duct. Such an embodiment of the pump turned out to be particularly advantageous.

Finally according to the invention the outlet end of the Z-shaped air duct may be an opening drilled in the bleed housing, whereby the bleed housing is particularly easily manufactured. In addition the air duct is particularly easily provided.

BRIEF DESCRIPTION OF DRAWINGS

The invention will be described below with reference to the accompanying drawings, in which.

DESCRIPTION OF PREFERRED EMBODIMENTS

Figure 1:
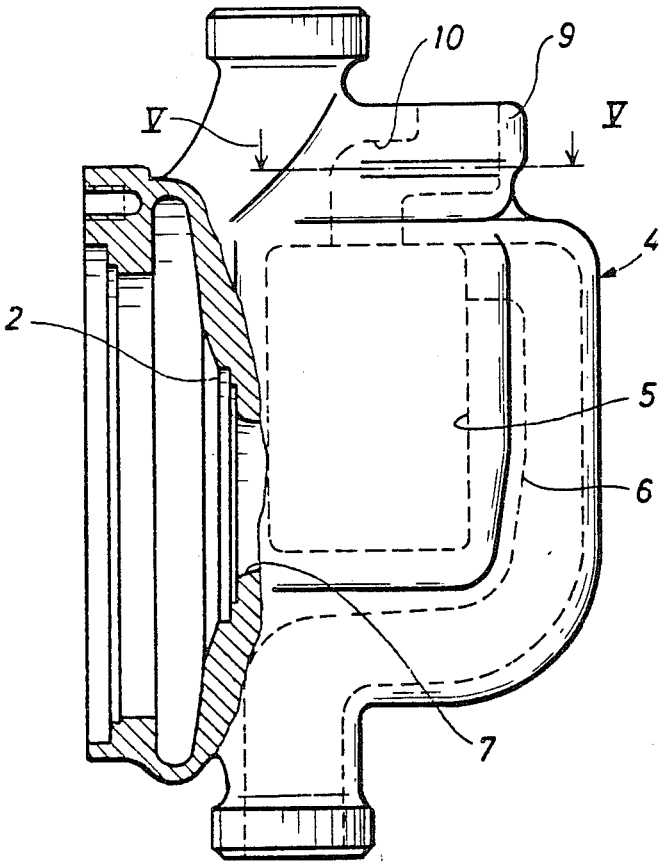
FIG. 1 is a side view of an embodiment of a portion of the inventive pump formed as a centrifugal pump, the gas separator situated in front of the pump inlet and the bleed housing thereof situated at the top appearing clearly.

The portion of a pump shown in FIG. 1 is a portion of a centrifugal pump, the inlet 2 of which appears on the left-hand side of the figure. The impeller of the pump is not shown but is situated to the left of the inlet 2. To the right of this inlet a gas separator 4 is provided. The gas separator is built integral with the pump housing but may, however, be a separate part. The gas separator 4 comprises a cyclone chamber 5 with an inlet channel 6 for the gas or air-containing pump medium, channel 6 also being indicated by a dotted line. The gas separator comprises further a liquid outlet channel 7 connected to the inlet 2 of the pump, and a bleed housing 9 situated at the upper end of the cyclone chamber 5 and comprising an air duct 10. As particularly clearly illustrated in FIG. 2 the channel 10 is substantially Z-shaped.

Figure 6:
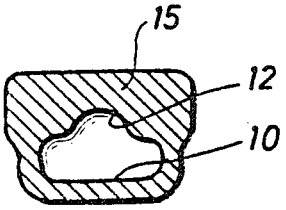
FIG. 6 is a sectional view taken along the line VI—VI of FIG. 3.

FIG. 6 illustrates particularly clearly how the cross section of the air duct, i.e. the non-hatched area, deviates from a circular shape. In FIG. 6 the cross section in question is rectangular with rounded ends. The air duct is furthermore provided with a groove 12, cf. the dotted line in FIG. 3. This groove extends in the upper wall 15 of the air duct and continues at least into a portion of the length of the air duct 10. The deviation of the cross section of the duct from a circular shape impedes the formation of water blockages in the channel because small amounts of gas or air leaking from the cyclone chamber into the bleed housing rise into the groove and thereby relatively easily penetrate the blockage. Upon penetration the blockage is disintegrated and the passage for gas or air is free in the entire cross section of the air duct. The water of the blockage flows quickly into the cyclone chamber.

Figure 2:
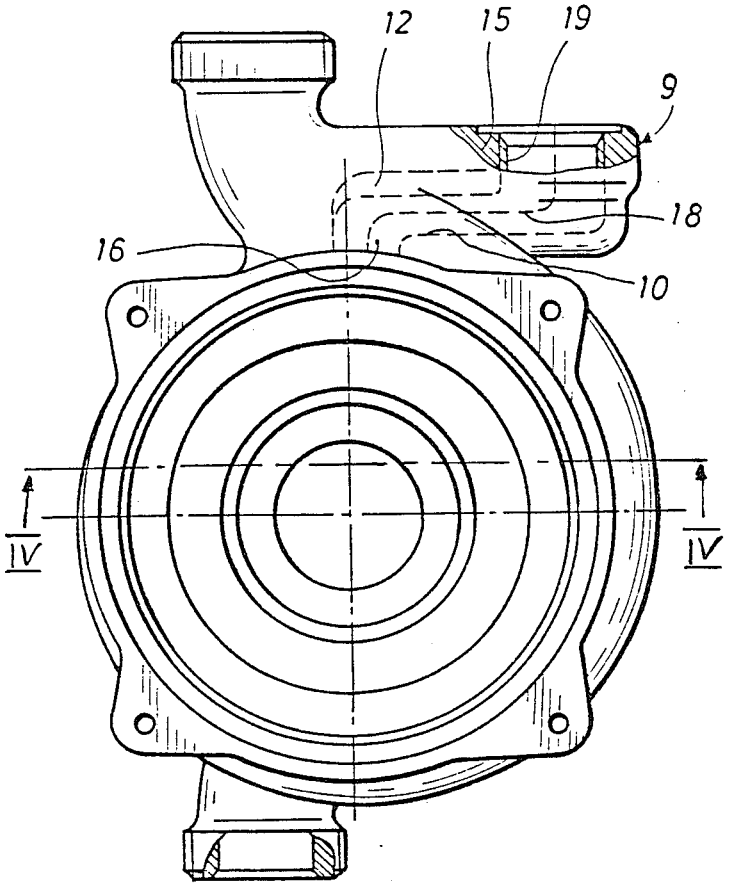
FIG. 2 is a front view of the embodiment of FIG. 1, whereby the inlet of the pump appears in the middle of the Figure and the bleed housing appears at the top thereof, the outlet end of the air duct being slightly cut.
Figure 3:
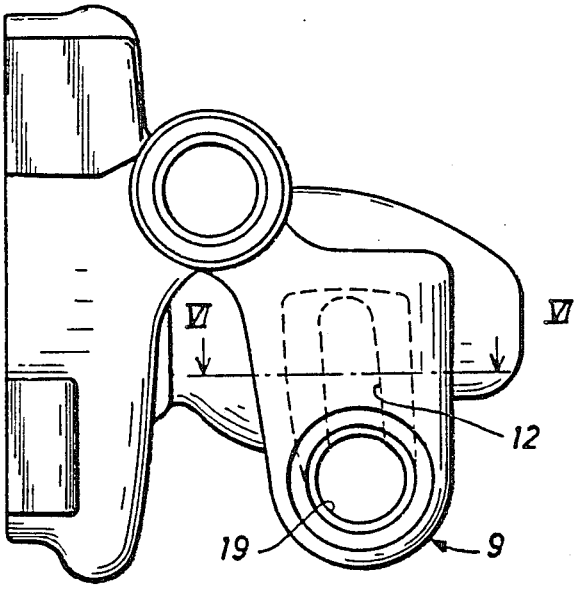
FIG. 3 is a top view of the embodiment of FIG. 1, whereby the bleed housing appears at the bottom to the right and whereby the groove of the bleed housing has been indicated by a dotted line.
Figure 4:
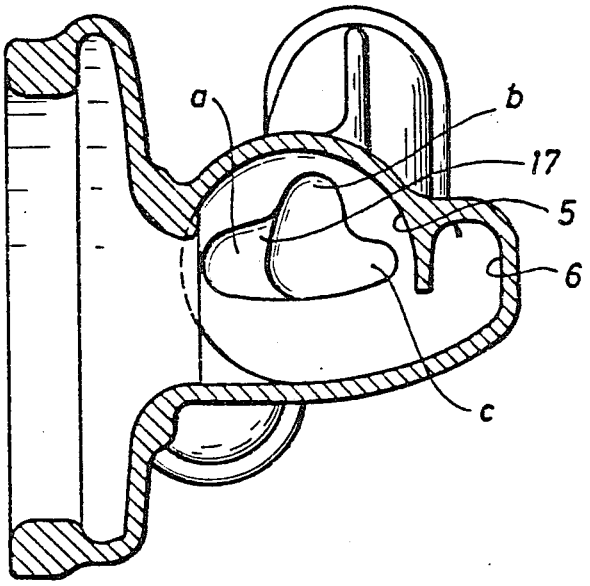
FIG. 4 is a sectional view taken along the line IV—IV of FIG. 2.

As illustrated in FIGS. 2 and 3, the groove 12 extends from the inlet 16 of the duct 10 to the outlet 19 of the duct. As illustrated in FIG. 4, the inlet 16 of the air duct may be substantially clover leaf-shaped. The three partial leaves of the clover leaf have been marked at a, b, and c. Immediately behind the flow cross section a the air duct 10 narrows because of an inlet surface 17, said surface implying that the gas or air flows into the groove 12 at a slight curvature.

Figure 5:
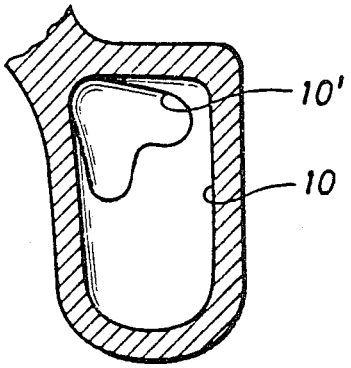
FIG. 5 is a sectional view taken along the line V—V of FIG. 1.

As illustrated in FIG. 5, the cross section of the air duct is substantially heart-shaped at a location 10' adjacent the inlet 16, but this cross section changes rapidly into the cross section of FIG. 6. Instead of the cross section of FIG. 6, the cross section may include a cross-sectional portion shaped as a flat oval plus a cross-sectional portion corresponding to the groove 12.

The groove 12 is preferably of a length in the range 0.4–0.7 times L, L being the length of the air duct 10 measured along the central line 18 of FIG. 2.

The outlet end of the air duct 10 can be an opening 19, cf. FIG. 2, drilled in the upper wall 15 of the bleed housing 9.

The invention may be varied in many ways without thereby deviating from the scope of protection.

We claim:

1. A pump preferably a centrifugal pump comprising a gas separator connected to the suction side of the pump housing wherein the gas separator comprises a cyclone chamber with an inlet channel for a gas-containing pump medium, a liquid outlet channel connecting the cyclone chamber to the inlet of the pump, and a bleed housing mounted at the upper end of the cyclone chamber and comprising an air duct, wherein the air duct is substantially Z-shaped and of a cross section deviating from a circular shape, and wherein at least over a portion of its length the air duct comprises a relatively wide groove in its upper wall, said groove extending from adjacent the inlet of said air duct to adjacent the outlet of said air duct.

2. A pump as in claim 1, wherein the cross section of the Z-shaped air duct is substantially clover leaf-shaped at the inlet of the air duct, i.e. at the connection between the air duct and the cyclone chamber, and wherein a portion of the air duct opposing one of the partial leaves of the clover leaf forms an inlet surface for the gas, said inlet surface continuing into said groove.

3. A pump as in claim 2, wherein the cross section of the Z-shaped air duct is substantially heart-shaped adjacent the inlet of the air duct.

4. A pump as in claim 1, wherein the cross section of the Z-shaped air duct is substantially heart-shaped adjacent the inlet of the air duct.

5. A pump as in claim 1, wherein the middle of the Z-shaped air duct (10) has a cross section composed of a cross-sectional portion shaped as a substantially compressed oval and a cross-sectional portion corresponding to said groove.

6. A pump as in claim 1, wherein the groove is of a length in the range 0.4–0.7 times L, where L is the length of the Z-shaped air duct.

7. A pump as in claim 1, wherein the outlet end of the Z-shaped air duct is an opening drilled in the bleed housing

* * * * *